US007250607B1

(12) United States Patent
Keck et al.

(10) Patent No.: US 7,250,607 B1
(45) Date of Patent: Jul. 31, 2007

(54) COLLIMATOR

(75) Inventors: Bradley Dwight Keck, Hamilton, OH (US); Robert Martin Beihn, Zionsville, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 73 days.

(21) Appl. No.: 11/066,085

(22) Filed: Feb. 25, 2005

Related U.S. Application Data

(60) Provisional application No. 60/547,558, filed on Feb. 25, 2004.

(51) Int. Cl.
*G21K 1/02* (2006.01)
*G21K 1/00* (2006.01)

(52) U.S. Cl. ..... 250/363.1; 250/505.1; 378/149

(58) Field of Classification Search ..... 250/363.1, 250/505.1; 378/149
See application file for complete search history.

(56) References Cited

U.S. PATENT DOCUMENTS 4,054,800 A * 10/1977 Leask ..... 378/149
4,118,632 A * 10/1978 Luig ..... 250/363.1
4,288,697 A 9/1981 Albert
4,419,585 A 12/1983 Strauss et al.
4,528,453 A 7/1985 Heller
4,792,686 A 12/1988 Karcher et al.
5,077,479 A 12/1991 de la Barre et al.
5,293,417 A 3/1994 Wei et al.
5,436,958 A 7/1995 Taylor
5,448,073 A * 9/1995 Jeanguillaume ..... 250/363.02
5,751,000 A 5/1998 McCroskey et al.
5,929,447 A 7/1999 Crandall et al.
6,271,524 B1 8/2001 Wainer et al.
6,353,227 B1 3/2002 Boxen
6,518,579 B1 * 2/2003 Xu et al. ..... 250/393

OTHER PUBLICATIONS

Votion, D.M., "Scintigraphy", *Equine Respiratory Diseases*, [online] Dec. 4, 2001, Publisher: International Veterinary Service [retrieved May 10, 2005] (www.ivis.org), Ithaca,NY, USA.
Corrado, M., "Preparazione Di Forme Farmaceutiche Orali Per Studi Di Farmacoscintigrafia", presentation, Switzerland, [retrieved May 10, 2005] <URL:www.pharm.unipmm.it/link_statici/giornate_di_studio_e_convegni/26_11_03/Corrado.pdf.>.
Merck Index, "Radioactive Isotopes Used in Medical Diagnosis and Therapy", [retrieved May 10, 2005], URL:themerckin1dex.cambridgesoft.com/.../AdditonalTables/pdfs/RadioactiveIsotopeusedinMedicalDiagnosis.pdf.
Theodorakis, M.C. et al., "External Scintigraphy in Monitoring the Behavior of Pharmaceutical Formulations In Vivo I: Technique for Acquiring High-Resolution Images of Tablets", *J. of Pharmaceutical Science*, 1983, vol. 72, No. 2, pp. 130-135.
Parr, A.F. et al., "Correlation of Ibuprofen Bioavailability with Gastrointestinal Transit by Scintigraphic Monitoring of $^{171}$Er-Labeled Sustained-Rlease Tablets", *Pharmaceutical Research*, 1987, vol. 4, No. 6, pp. 486-489.

(Continued)

*Primary Examiner*—David Porta
*Assistant Examiner*—Mindy Vu
(74) *Attorney, Agent, or Firm*—Andrew A. Paul; David V. Upice

(57) ABSTRACT

A collimator suitable for the collimation of high energy gamma photons.

18 Claims, 4 Drawing Sheets

OTHER PUBLICATIONS

Digenis, G.A. et al., "Gastrointestinal Behavior of Orally Administered Radiolabeled Erythromycin Pellets in Man as Determined by Gamma Scintigraphy", *J. Clin. Pharmacol*, 1990, vol. 30, pp. 621-631.

Digenis, G.A. et al., "Dual-Isotope Imaging of Neutron-Activated Erbium-171 and Samarium-153 and the in vivo Evaluation of a Dual-Labeled Bilayer Tablet by Gamma Scintigraphy", *Pharmaceutical Research*, 1991, vol. 8, No. 10, pp. 1335-1340.

Wilding, I.R. et al, "In Vivo Evaluation of Enteric-Coated Naproxen Tablets Using Gamma Scintigraphy", *Pharmaceutical Research*, 1992, vol. 9, No. 11, pp. 1436-1441.

Adkin, D.A. et al., "The effects of pharmaceutical excipients on small intestinal transit", *Br. J. Clin. Pharmacol.*, 1995, vol. 39, No. 4, pp. 381-387.

Burton, S. et al., "Intragastric Distribution of Ion-exchange Resins: a Drug Delivery System for the Topical Treatment of the Gastric Mucosa", *J. Pharm. Pharmacol.*, 1995, vol. 47, pp. 901-906.

Adkin, D.A. et al., "The Use of Scintigraphy to Provide 'Proof of Concept' for the Novel Polysaccharide Preparations Designed for colonic Drug Delivery", *Pharmaceutical Research*, 1997, vol. 14, No. 1, pp. 103-107.

Wilding, I.R. et al., "Gastrointestinal spread of oral prolonged-release mesalazine microgranules (Pentasa) dosed as either tablets or sachet", *Aliment Pharmacol Ther.*, 2000, vol. 14, pp. 163-169.

Perkins, A.C. et al., "Oesophgeal transit, disintegration and gastric emptying of a film-coated risedronate placebo tablet in gastro-oesophageal reflux disease and normal control subjects", *Aliment Pharmacol Ther.*, 2001, vol. 15, pp. 115-121.

Perkins, A.C. et al., "Impaired oesophageal transit of capsule versus tablet formulations in the elderly", *Gut*, 1994, vol. 35, No. 10, pp. 1363-1367.

Billa, N. et al., "Gamma-scintigraphic study of the gastrointestinal transit and in vivo dissolution of a controlled release diclofenac sodium formulation in xanthan gum matrices", *International J. Pharmaceutics*, 2000, vol. 201, pp. 109-120.

Perkins, A.C. et al., "The use of scintigraphy to demonstrate the rapid esophaegeal trnsit of the oval film-coated placebo risdronate tablet compared to a round uncoated placebo tablet when administered with minimal volumes of water", *International J. of Pharmaceutics*, 2001, vol. 222, pp. 295-303.

* cited by examiner

COLLIMATOR

CROSS REFERENCE TO RELATED APPLICATION

This application claims the benefit of U.S. Provisional Application No. 60/547,558, filed 25 Feb. 2004.

FIELD OF THE INVENTION

The present invention is directed to a collimator for improved collimation of gamma photons, e.g. those emanating from sodium-24.

BACKGROUND OF THE INVENTION

In order for Anger gamma cameras to form an image showing the distribution of radioactive material in an object or in a patient, a means is necessary to determine the location of the radioactive material. This means usually comprises of a collimator attached to the face of the camera to control the direction of the detected gamma rays or other radiation emanating from the radioactive material. The control of directionality occurs at each location on the camera face by means of collimation channels which allow gamma rays (or other radiation) through only if they come from within an acceptance angle.

In a parallel-hole collimator, the apertures are parallel to each other, perpendicular to the crystal of the camera face, long enough and of small enough diameter that the acceptance angle is narrow. The apertures are packed closely enough together, in most cases, that the intrinsic resolution of the camera does not allow resolution of the apertures on the final image. The result is an acceptable 1:1 relation between direction of origin of the gamma rays and site of interaction with the camera crystal. This allows an image to be formed by film or a computer since the electronics of the camera are able to localize the site of interaction of each gamma ray with the crystal.

Gamma cameras sometimes are used in connection with so called high-energy isotopes. Many references define "high energy" or "super high energy" isotopes as those that undergo positron emission and the accompanying 511 keV photons (e.g., fluorine-18, iodine-123, carbon-11, nitrogen-13 and oxygen-15). As such, these collimators are designed around the 511 keV emission, and generally have a working range not in excess of 600 keV. Sodium-24 is a radioactive isotope produced by the neutron irradiation of stable sodium (Na-23). Sodium is found in many products, with specific mention to pharmaceutical dosage forms such as capsules and tablets. As such, sodium-24 is a desirable isotope for radionuclide imaging studies. However, sodium-24 has gamma rays of 1368 and 2754 KeV—well beyond the range of many of the so-called "super high energy" known collimators. Particularly, the gamma rays from sodium-24 penetrate through known collimator septa resulting in a scatter of gamma photons, which interact with the crystal, or detector, of the gamma camera resulting in reduced image resolution.

Accordingly, there is a need for a collimator that reduces the scatter of high-energy gamma photons, e.g. those from sodium-24, thereby providing enough resolution for high energy gamma photon, e.g. sodium-24, radionuclide imaging using a gamma scintillation camera.

SUMMARY OF THE INVENTION

The present invention provides a collimator suitable for the collimation of high energy gamma photons, e.g. sodium-24. One aspect of the invention provides for a collimator that comprises a plurality of perpendicular collimation channels having septa that may be comprised of, e.g., lead, tungsten, or uranium. For example, if the septa are comprised of lead, the septa thickness is typically at least 0.6 millimeters and the channels typically have a channel depth of at least 12 centimeters and typically have an average collimation channel diameter of 3 millimeters to 7 millimeters. The dimensions of the septa thickness, channel depth, and average collimation channel diameter will change if collimator is made of tungsten or uranium since these materials exhibit greater gamma ray attenuating properties as compared to lead.

The present invention is based upon the surprising discovery that the collimators claimed herein manage the scatter of photons emissions of 1368 and 2754 KeV while preserving adequate sensitivity and allow imaging resolution and quantitation, with specific mention to large animal or human work in pharmaceutical development.

Without wishing to be bound by theory, the decreased scattering and hence increased resolution of the present invention may be attributed to the increased thickness of collimator coupled with increased septum thickness.

BRIEF DESCRIPTION OF THE DRAWINGS

The invention may take form in various components and arrangements of components, and in various steps and arrangement of steps. The drawings are only for purposes of illustrating the preferred embodiments and are not to be construed as limiting the invention.

DETAILED DESCRIPTION OF THE INVENTION

Figure 1:
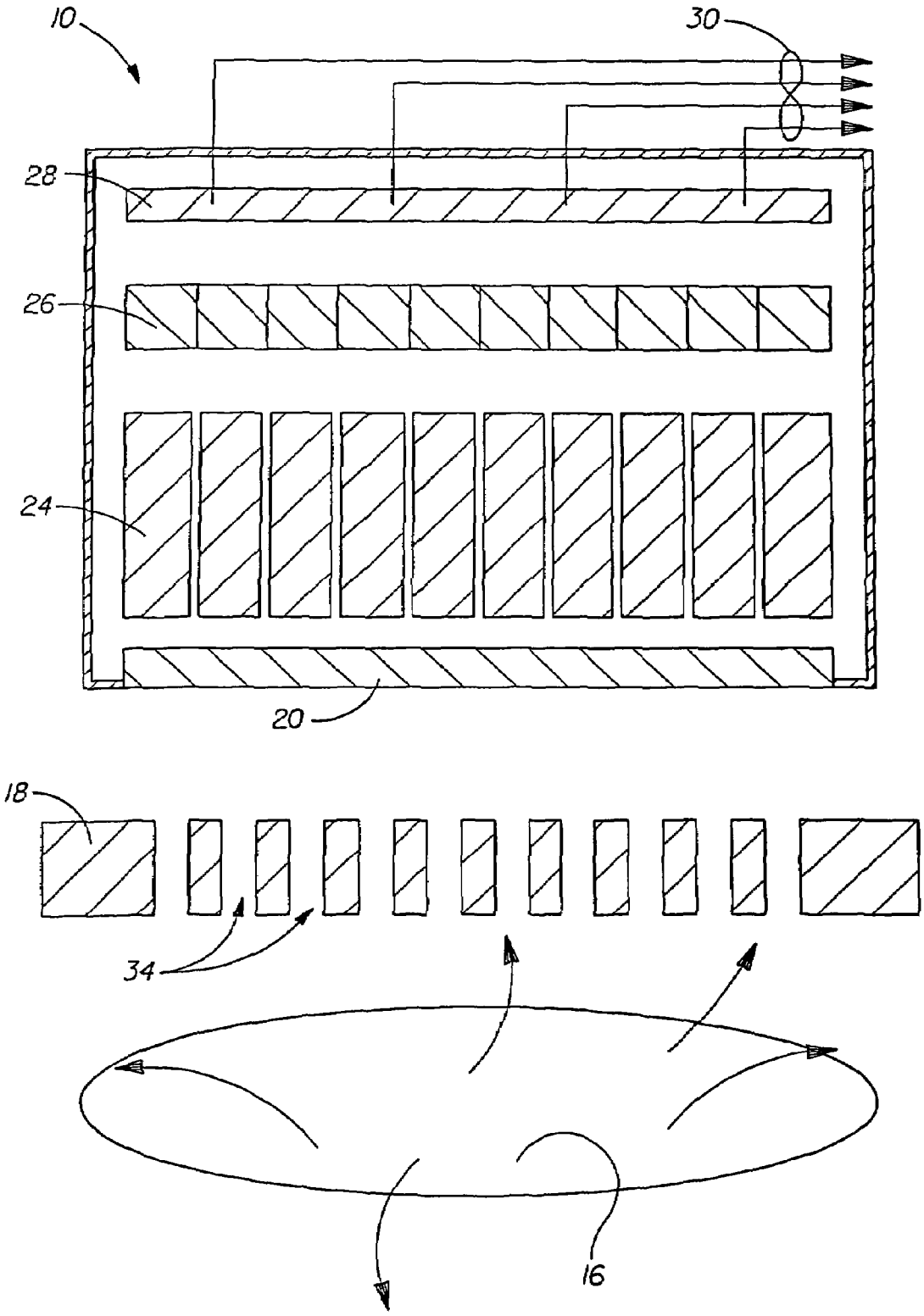
FIG. 1 is a cross-section schematic illustration of a gamma camera not drawn to scale.

FIG. 1 is a cross-section schematic illustration, not drawn to scale, of a gamma camera 10 to detect high-energy gamma photons, e.g. those from sodium-24, within a sample or subject, generally designated at 16. Gamma camera 10 further includes collimator 18 and a scintillation crystal 20. Collimator 18 transfers a gamma ray image of a radioactivity distribution from a high-energy gamma photon, e.g. sodium-24, source 16 onto scintillation crystal 20. Upon reception of gamma rays, a light event, or incident, occurs, thus causing scintillating crystal 20 to emit a burst of light photons. The light photons emitted at the scintillation points in crystal 20 following absorption of the individual gamma rays pass through a closely-packed array of photomultiplier tubes (PMTs) 24. The total electric charge in the electrical pulses from the output of PMTs 24 is proportional to the mean number of photons received by the photocathode of each PMT 24. These pulses contain information on both the energy absorbed within crystal 20 from the gamma rays and the position of the scintillation point, or event. The pulses are then amplified and fed to analog-to-digital converters (ADCs) 26. In one embodiment, the signals from PMTs 24 may be summed prior to being provided to ADCs 26. ADCs 26 convert the PMT 24 analog outputs to digital signals, which are then processed by circuitry 28. Particularly, camera 10 produces signals on output lines 30 which are transmitted to a processing unit for generating an image for display on, for example, a cathode ray tube (not shown). The signals output on output lines 30 also typically are stored in the memory of a computer (not shown). The camera used must accommodate pulse heights that correspond to photon energies of at least 1.36 MeV, and optimally will also allow pulse heights of 2.75 MeV. In both cases, an energy window of +/−10% is used. This sufficiently rejects scattered photons while allowing an adequate efficiency at the energies of interest.

Collimator 18 defines a field of view (FOV) of gamma camera 10. Collimator 18 is fabricated from gamma ray attenuating material and defining a plurality of collimation channels 34. Collimation channels 34 are perpendicular to crystal 20. Collimator 18 substantially extends across an entire face of crystal 20.

Figure 2:
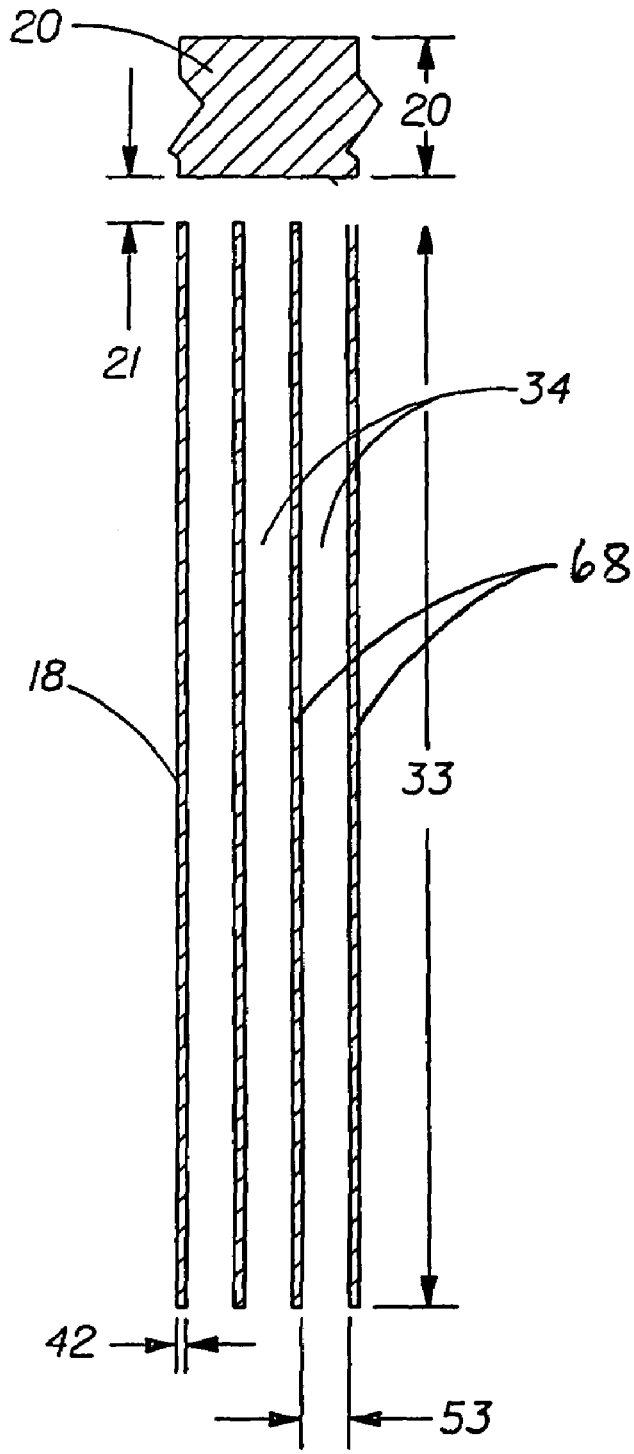
FIG. 2 is a cross-section of a collimator according to the present invention and a crystal.

FIG. 2 is a cross section of a collimator 18 of the present invention and a crystal 20. Collimator 18 and crystal 20 have a collimator/crystal interface distance 21 preferably at or less than 0.5 centimeters for improved image resolution. Crystal 20 preferably is sodium iodide doped with thallium (NaI:T1) and typically has a crystal thickness 20 of at least 1.2 cm. A person skilled in the art will recognize that other scintillating media may also be used in combination with this collimator, for example cesium iodide or cadmium zinc telluride, so long as their thickness allows the equivalent stopping power of about 1.2 cm of NaI:T1.

One embodiment of the invention provides for collimator 18 to be comprised of lead as the gamma ray attenuating material. In such an embodiment, the collimation channels 34 of collimator 18 typically have a collimation channel depth 33 of at least 12 centimeters, and typically have a collimation channel diameter 53 from 3 to 7 millimeters. Further, collimation septa 68 of collimator 18 typically have a collimation septa thickness 42 of at least 0.6 millimeters. As used herein, "collimation septa" or "collimation septum" is the gamma ray attenuating material between adjacent collimation channels 34, wherein the thickness is measured at the narrowest point between the adjacent collimation channels.

Another embodiment of the invention provides for collimator 18 to be comprised of tungsten as the gamma ray attenuating material. In such an embodiment, the collimation channels 34 of collimator 18 typically have a collimation channel depth 33 greater than 6 centimeters, and typically have a collimation channel diameter 53 of 3 to 7 millimeters. Further, collimation septa 68 of collimator 18 typically have a collimation septa thickness 42 of at least 0.5 millimeters.

Still another embodiment of the invention provides for collimator 18 to be comprised of uranium as the gamma ray attenuating material. In such an embodiment, the collimation channels 34 of collimator 18 typically have a collimation channel depth 33 of greater than 6 centimeters, and typically have a collimation channel diameter 53 of 3 to 7 millimeters. Further, collimation septa 68 of collimator 20 typically have a collimation septa thickness 42 greater than 0.4 millimeters.

Figure 3:
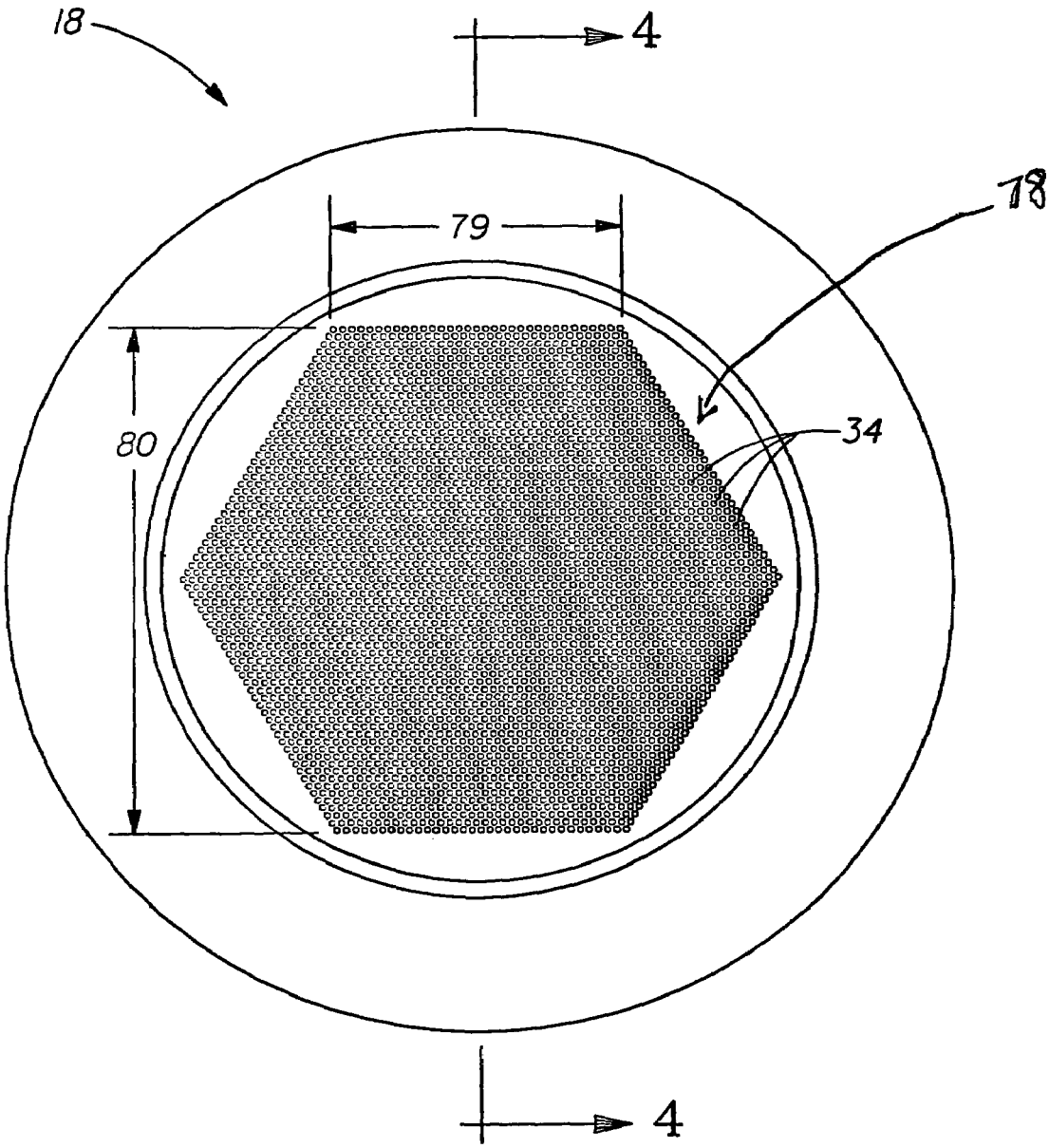
FIG. 3 is a top view of the collimator shown in FIG. 2.

FIG. 3 is a top view of collimator 18 of FIG. 2 comprised of lead. Collimation channels 34, arranged in a collimation channel array 78, each have cross sections that are circles typically having a diameter of 4 millimeters. However, one skilled in the art will appreciate that collimation channels 34 can have cross sections of a variety shapes including circles, squares, octagonal, hexagons, and mixtures thereof, where all the regular polygons have their diameter measured at the greatest distance point to point (e.g., diagonally in a square). The collimation channels array 78 may be arranged in a hexagonal pattern as in FIG. 3 typically having a collimation channel array width 80 of 37.5 centimeters and a collimation channel array length 79 of 42 centimeters. The width 80 and length 79 for a collimation channel array 78 should approximate the corresponding dimensions of the particular gamma camera to be used, thus the size may vary on this basis.

Figure 4:
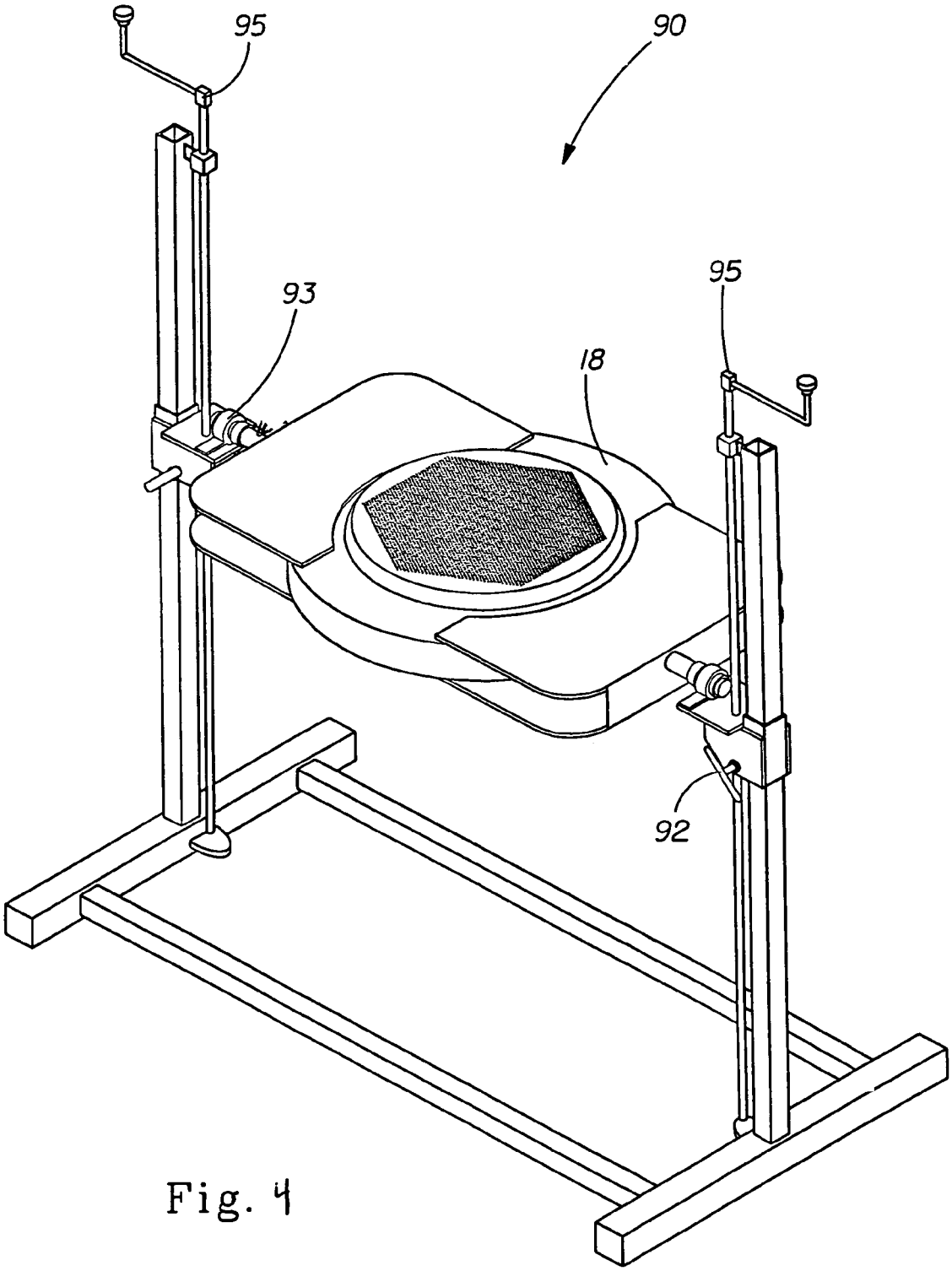
FIG. 4 is a perspective view of the collimator shown in FIGS. 2 and 3 in a collimator support frame.

FIG. 4 is a perspective view of collimator 18 shown in FIGS. 2 and 3 in a collimator support frame 90. In FIG. 4, collimator 18 may be mounted on a portable, positionable, collimator support frame 90 having support frame adjusting cranks 95 that can adjust the vertical height of the collimator 18 relative to the sodium-24 (or other high-energy gamma photon) source (not shown). The collimator support frame 90 may also have a bearing 93 for rotation and a lock 92 to secure the position of collimator 18.

EXAMPLES

Example 1

A collimator of the present invention may be constructed from two or more known collimators. In a specific example, two Technicare™ high-energy collimators, designed for use at 400 keV, are aligned and joined together using a steel collar with bolted and welded plates.

Example 2

Three Technicare™ 400 keV collimators are aligned and joined together, each having the same collimation channel pattern, wherein each channel is aligned, and the entire assembly is joined together using a steel collar with bolted and welded plates.

Except as otherwise noted, all amounts including parts, percentages, and proportions are understood to be modified by the word "about", and amounts are not intended to indicate significant digits. Except as otherwise noted, the articles "a," "an," and "the" mean "one or more" unless context clearly requires them not to.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A collimator comprising a plurality of collimation channels and collimation septa; wherein:

(a) said collimation channels have a collimation channel depth of at least about 12 cm and an average collimation channel diameter from about 3 mm to about 7 mm; and (b) said collimation septa are comprised substantially of lead and have a septa thickness of at least about 0.6 mm.

2. The collimator of claim 1, wherein said collimation channels are parallel to one another.

3. The collimator of claim 2, wherein said collimation channels are in a collimation channel array formed into a hexagonal pattern.

4. The collimator of claim 2, wherein said collimation channels have a cross section chosen from circle, square, octagon, hexagon, and mixtures thereof.

5. A gamma camera comprising a collimator according to claim 1 and a scintillation crystal.

6. The gamma camera of claim 5, wherein said collimation channels are arranged perpendicular to said scintillation crystal.

7. A collimator comprising a plurality of collimation channels and collimation septa; wherein:

(a) said collimation channels have a collimation channel depth of greater than about 6 cm and an average collimation channel diameter from about 3 mm to about 7 mm; and (b) said collimation septa are comprised substantially of tungsten and have a septa thickness of at least about 0.5 mm;

wherein said collimator is suitable for the collimation of photon emissions of 1368 KeV and 2754 KeV.

8. The collimator of claim 7, wherein said collimation channels are parallel to one another.

9. The collimator of claim 8, wherein said collimation channels are in a collimation channel array formed into a hexagonal pattern.

10. The collimator of claim 8, wherein said collimation channels have a cross section chosen from circle, square, octagon, hexagon, and mixtures thereof.

11. A gamma camera comprising a collimator according to claim 7 and a scintillation crystal.

12. The gamma camera of claim 11, wherein said collimation channels are arranged perpendicular to said scintillation crystal.

13. A collimator comprising a plurality of collimation channels and collimation septa; wherein:

(a) said collimation channels have a collimation channel depth of greater than about 6 cm and an average collimation channel diameter from about 3 mm to about 7 mm; and (b) said collimation septa are comprised substantially of uranium and have a septa thickness greater than about 0.4 mm;

wherein said collimator is suitable for the collimation of photon emissions of 1368 KeV and 2754 KeV.

14. The collimator of claim 13, wherein said collimation channels are parallel to one another.

15. The collimator of claim 14, wherein said collimation channels are in a collimation channel array formed into a hexagonal pattern.

16. The collimator of claim 14, wherein said collimation channels have a cross section chosen from circle, square, octagon, hexagon, and mixtures thereof.

17. A gamma camera comprising a collimator according to claim 13 and a scintillation crystal.

18. The gamma camera of claim 17, wherein said collimation channels are arranged perpendicular to said scintillation crystal.

* * * * *